US007705841B2

(12) United States Patent
Lin

(10) Patent No.: US 7,705,841 B2
(45) Date of Patent: Apr. 27, 2010

(54) DISPLAY SYSTEM AND METHOD FOR EMBEDDEDLY TRANSMITTING DATA SIGNALS, CONTROL SIGNALS, CLOCK SIGNALS AND SETTING SIGNALS

(75) Inventor: Che-Li Lin, Taipei (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 738 days.

(21) Appl. No.: 11/464,827

(22) Filed: Aug. 15, 2006

(65) Prior Publication Data

US 2007/0171161 A1 Jul. 26, 2007

Related U.S. Application Data

(60) Provisional application No. 60/766,453, filed on Jan. 20, 2006.

(51) Int. Cl.
*G09G 5/00* (2006.01)

(52) U.S. Cl. ..... 345/208

(58) Field of Classification Search ..... 345/87
See application file for complete search history.

(56) References Cited

U.S. PATENT DOCUMENTS 4,271,409 A * 6/1981 Filliman ..... 345/603
6,104,360 A * 8/2000 Kim ..... 345/11
7,061,459 B2 6/2006 Koizumi
2002/0186213 A1* 12/2002 Koizumi ..... 345/208
2004/0217953 A1* 11/2004 Someya et al. ..... 345/204
2007/0080905 A1* 4/2007 Takahara ..... 345/76
2008/0246755 A1* 10/2008 Lee ..... 345/214
2009/0079719 A1* 3/2009 Lee ..... 345/204
2009/0167750 A1* 7/2009 Hong et al. ..... 345/213
2009/0251454 A1* 10/2009 Jang ..... 345/213

FOREIGN PATENT DOCUMENTS

CN 1385829 A 12/2002
JP P2003-241720 A 8/2003

OTHER PUBLICATIONS

NS Manju Nath., Competing standards seek common ground for flat-panel displays, Jun. 10, 1999, EDN; Boston (0012-7515), vol. 44, Iss.12;p. 103.*
NS Manju Nath, Competing standards seek common ground for flat-panel displays, Jun. 10, 1999, EDN; Boston (0012-7515), vol. 44, Iss 12; p. 103.*

* cited by examiner

*Primary Examiner*—Richard Hjerpe
*Assistant Examiner*—Dorothy Webb
(74) *Attorney, Agent, or Firm*—Winston Hsu

(57) ABSTRACT

A display system includes a display panel, a timing controller, a plurality of source drivers and an EDDS interface. The control signals, the clock signals and the setting signals generated by the timing controller are embedded as protocols into the data signals. The embedded signals are then transmitted from the timing controller to each source driver via a corresponding pair of differential data lines of the EDDS interface. The decoders of the source drivers can then decode the embedded signals for generating corresponding driving signals for the display panel.

19 Claims, 4 Drawing Sheets

DISPLAY SYSTEM AND METHOD FOR EMBEDDEDLY TRANSMITTING DATA SIGNALS, CONTROL SIGNALS, CLOCK SIGNALS AND SETTING SIGNALS

CROSS REFERENCE TO RELATED APPLICATIONS

This application claims the benefit of the filing date of U.S. provisional patent application No. 60/766,453, filed Jan. 20, 2006, the contents of which are hereby incorporated by reference.

BACKGROUND OF THE INVENTION

1. Field of the Invention

The present invention relates to a display system and a related data transmission method, and more particularly, to a display system and a related data transmission method capable of embeddedly transmitting data signals, control signals, clock signals and setting signals.

2. Description of the Prior Art

With rapid development of display technologies, traditional cathode ray tube (CRT) displays have been gradually replaced by flat panel displays (FPDs) that have been widely applied in various electronic products such as notebook computers, personal digital assistants (PDAs), flat panel televisions, or mobile phones. Common FPD devices include thin-film transistor liquid crystal display (TFT-LCD) devices, low temperature poly silicon liquid crystal display (LTPS-LCD) devices, and organic light emitting diode (OLED) display devices. The driving system of a display device includes a timing controller, a source driver, a gate driver and signal lines (such as clock lines, data lines and control lines) for transmitting various signals.

Reference is made to FIG. 1 and FIG. 2. FIG. 1 illustrates a prior art L-configuration LCD device 10, and FIG. 2 illustrates a prior art T-configuration LCD device 20. Each of the LCD devices 10 and 20 includes an LCD panel 12, a timing controller 14, a plurality of gate drivers 16, a plurality of source drivers $CD_1$-$CD_n$, and a plurality of signal lines. The timing controller 14 generates data signals $DATA_1$-$DATA_m$ corresponding to images to be displayed by the LCD panel 12, setting signals for setting the pin voltage levels of the source drivers $CD_1$-$CD_n$, together with a clock signal CLK and control signals for driving the LCD panel 12. The setting signals shown in FIGS. 1 and 2 include DATAPOL signals, SHL signals and SHR signals for respectively setting the data-inversion pins, the shift-left pins and the shift-right pins of the source drivers $CD_1$-$CD_n$. Another way to set the pin voltage levels of the source drivers $CD_1$-$CD_n$ is to use pull-high or pull-low resistors on the driving system. The control signals shown in FIGS. 1 and 2 include latch control signals LD, polarity control signals POL, and start pulse signal SP. The start pulse signal SP is transmitted from the timing controller 14 to the source driver CD1 via a signal line of a transistor-transistor logic (TTL) interface, a complementary-metal-oxide-semiconductor (CMOS) interface or other compatible interfaces, and then from the source driver $CD_1$ to subsequent source drivers sequentially. The clock signal CLK, the setting signals (such as DATAPOL, SHL and SHR), other control signals (such as LD and POL), and the data signals $DATA_1$-$DATA_m$ are transmitted from the timing controller 14 to the source drivers $CD_1$-$CD_n$ via corresponding signal lines of a reduced swing differential signaling (RSDS) interface. Among them, the setting signals (such as DATAPOL, SHL and SHR) can be also hard-wired set in $CD_1$-$CD_n$ pins. The control signals (such as LD and POL) can also be transmitted via a TTL interface, a CMOS interface or other compatible interfaces.

In the prior art LCD devices 10 and 20, the data, control, setting and clock signals are transmitted via respective signals lines of an RSDS interface, a TTL interface or a CMOS interface. The RSDS/TTL/CMOS interface provides a bus type transmission that easily results in signal skewing, making it difficult to adjust timing parameters, such as the setup time or the hold time. Therefore, the data rate or the clock rate cannot be increased for high-speed operations in high-resolution display devices. Also, the clock and data signals are transmitted via different signal lines. With increasing demand for large-sized applications, the printed circuit board (PCB), on which the signal lines are disposed, also increases with panel size. Therefore, the trace delay from the timing controller to different source drivers also varies, thus making it even more difficult to adjust skew issue and the timing parameters. In the prior art LCD devices 10 and 20, various signals are transmitted via respective signals lines which occupy large circuit space on the PCB. The synchronization between the control signals and the clock signal in high-speed operations cannot be addressed by the prior art LCD devices 10 and 20. Also, setting signals are required for setting various pins of the source drivers (such as shift-right pins, shift-left pins, data-inversion pins, low-power-mode pins, and charge-sharing-mode pins) so that each source driver can function properly. Thus, the total number of input pins of the source drivers will be increased. Subsequently, the pin pitch of the source drivers has to be reduced and the yield of the bonding process will be lowered. The manufacturing costs of the display devices will be increased.

SUMMARY OF THE INVENTION

The present invention provides a display system capable of embeddedly transmitting data signals, control signals, clock signals and setting signals via an EDDS (embedded-all in data lines differential signaling) interface comprising an outputting means for outputting embedded signals including data signals, control signals, clock signals and setting signals; a first receiving means operative based on a first setting signal, the data signals, the control signals, and the clock signals, and comprising a first decoding means for decoding a first embedded signal and thereby generating a corresponding driving signal; a second receiving means operative based on a second setting signal, the data signals, the control signals, and the clock signals, and comprising a second decoding means for decoding a second embedded signal and thereby generating the corresponding driving signal; and an EDDS interface comprising: a first pair of differential data lines for transmitting the first embedded signal outputted by the outputting means to the first receiving means; and a second pair of differential data lines for transmitting the second embedded signal outputted by the outputting means to the second receiving means.

The present invention provides a display system comprising a display panel having a plurality of scan lines and a plurality of data lines formed in a matrix type; a plurality of gate drivers coupled to the display panel for driving the scan lines; a plurality of source drivers coupled to the display panel for driving the data lines; and a timing controller for providing at least one data signal, at least one control signal, at least one clock signal and at least one setting signal to the source driver; wherein the data signal, the control signal, the clock signal and the setting signal are transformed into at least one composite signal and transmitted from the timing controller to the source driver through at least one data differential pair.

The present invention also provides a method for embeddedly transmitting data signals, control signals, clock signals and setting signals comprising generating a first composite signal by embedding a first control signal, a first setting signal and a clock signal into a first data signal; generating a second composite signals by embedding a second control signal, a second setting signal and the clock signal into a second data signal; transmitting the first composite signal to a first receiving means; transmitting the second composite signal to a second receiving means; decoding the first composite signal; and decoding the second composite signal.

The present invention also provides a method for transmitting driving signals in a display system comprising transforming at least one data signal, at least one control signal, at least one clock signal and at least one setting signal into at least one composite signal; transmitting the composite signal from a timing controller to a source driver through at least one data differential pair; and receiving and decoding the composite signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
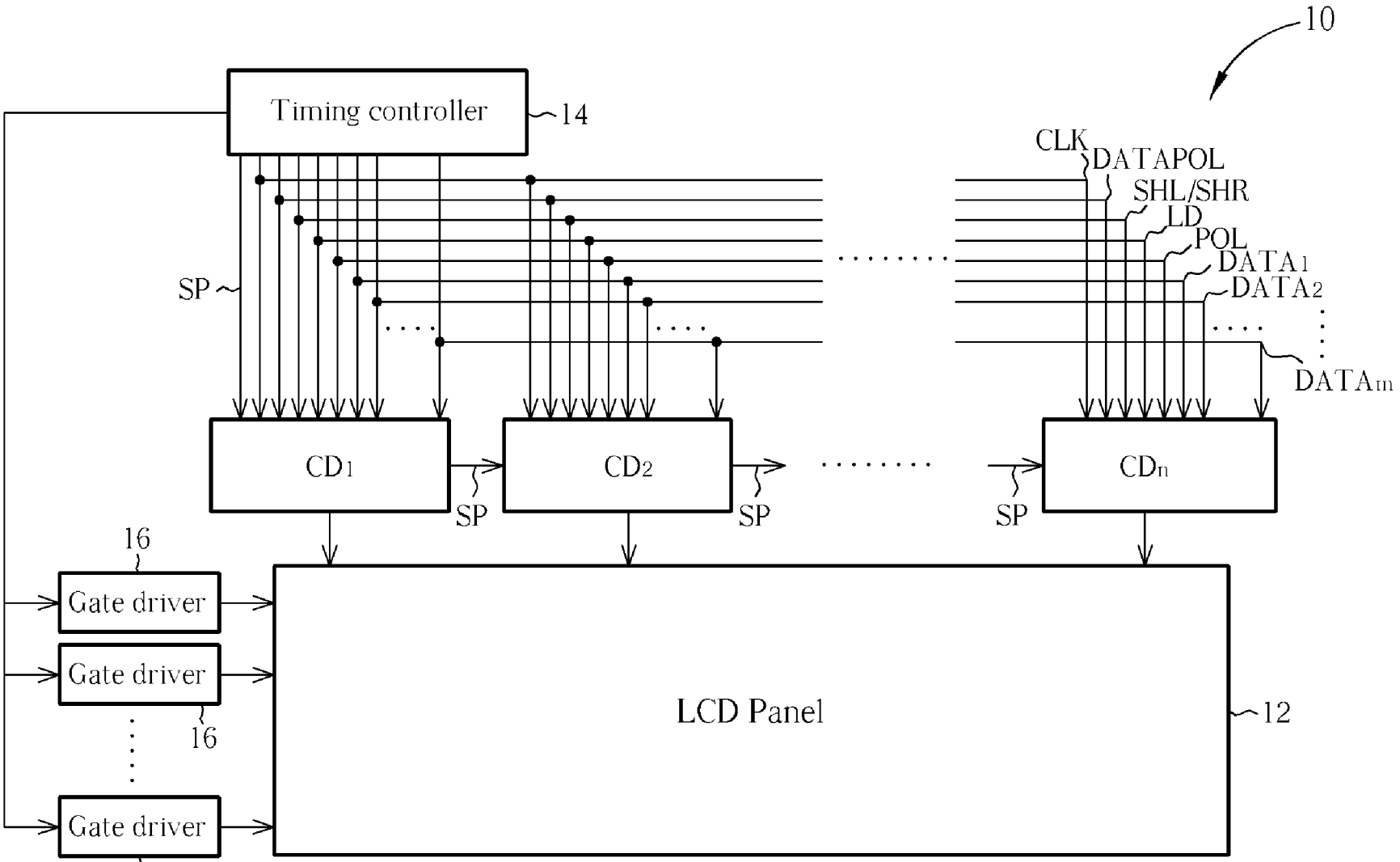
Fig. 1 Prior Art
FIG. 1 is a diagram of a prior art L-configuration LCD device.
Figure 2:
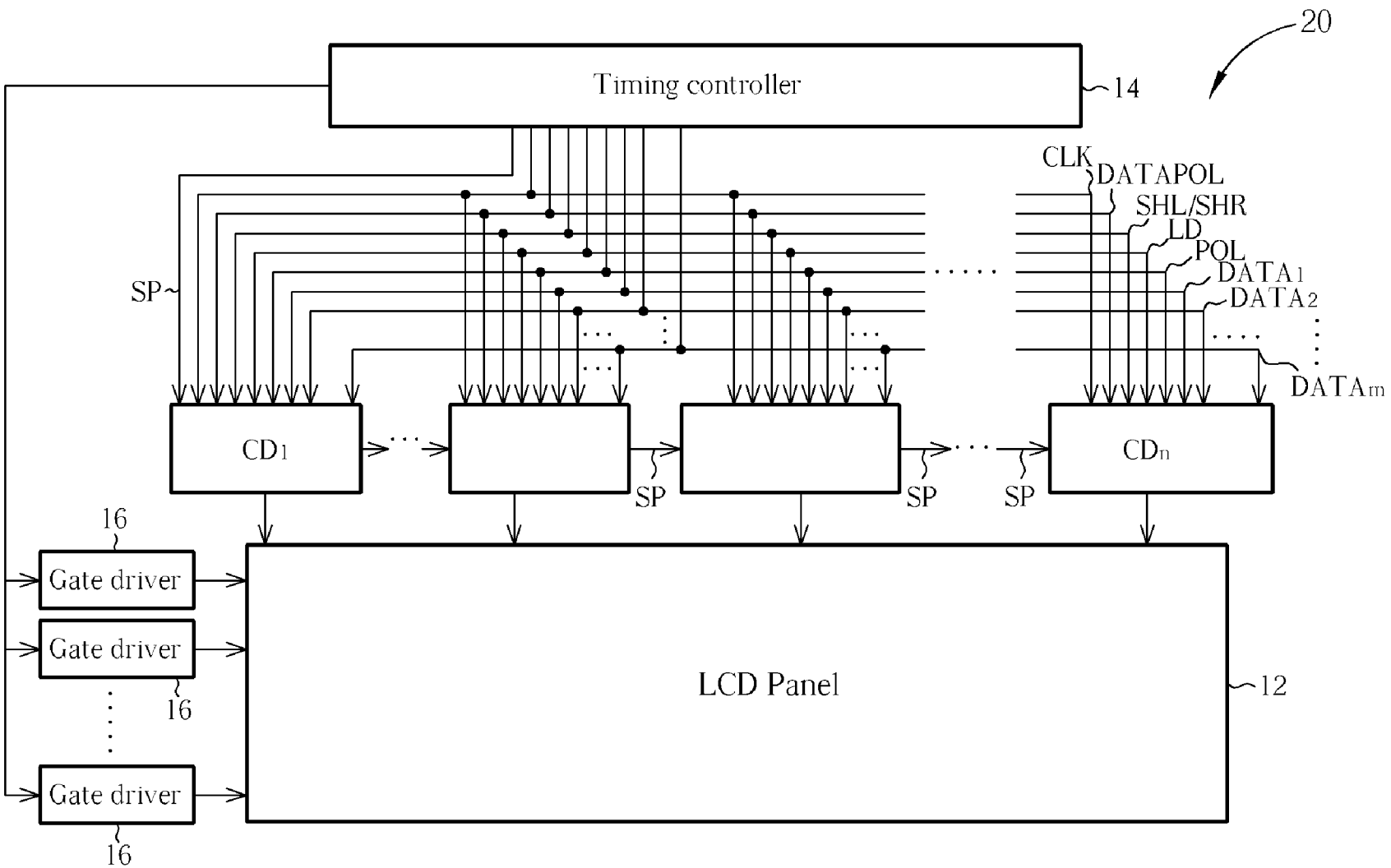
Fig. 2 Prior Art
FIG. 2 is a diagram of a prior art T-configuration LCD device.
Figure 3:
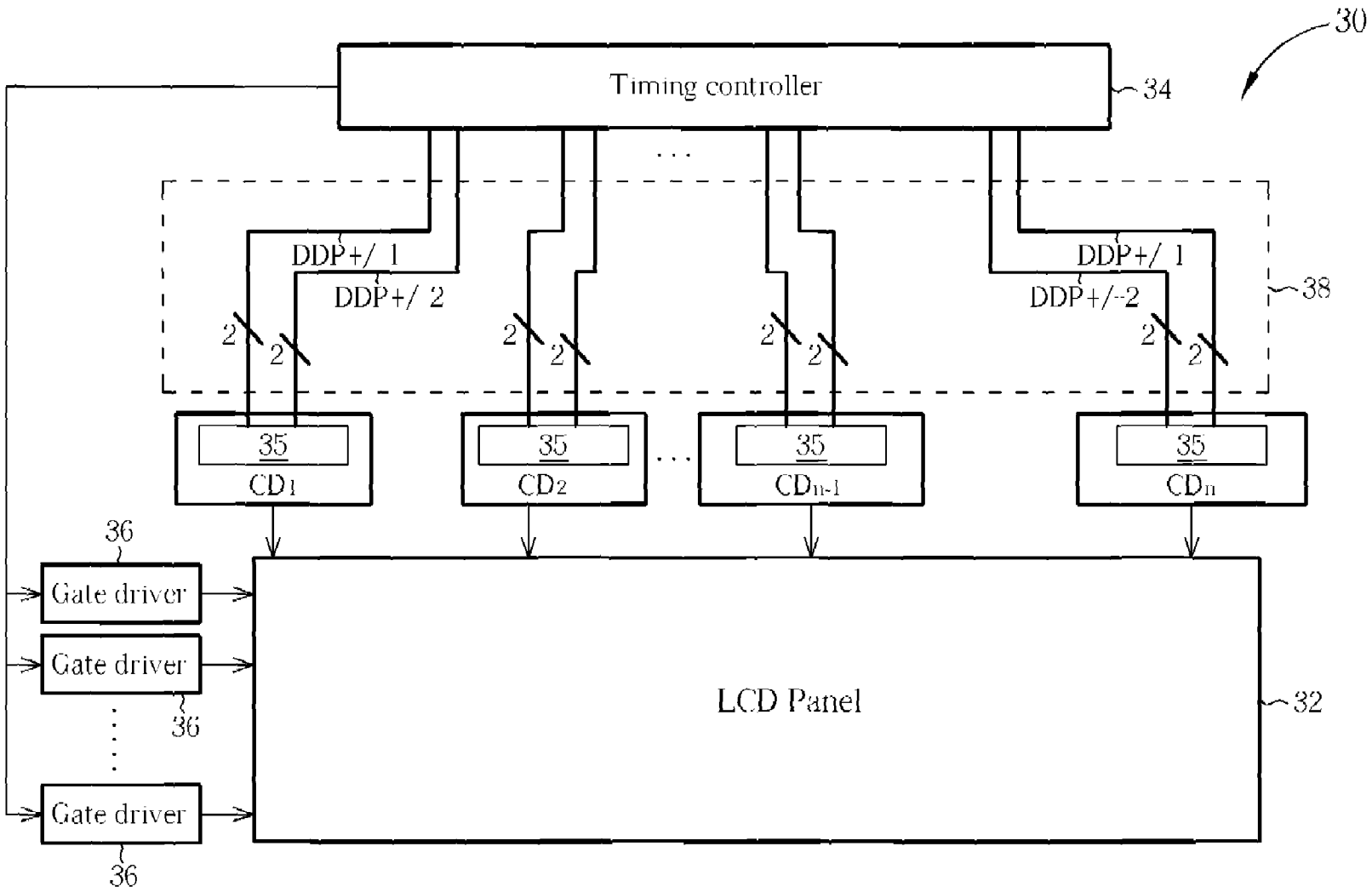
FIG. 3 is a diagram of an LCD device according to the present invention.

Reference is made to FIG. 3 for a diagram illustrating an LCD device 30 according to the present invention. The LCD device 30 includes an LCD panel 32, a timing controller 34, a plurality of gate drivers 36, a plurality of source drivers $CD_1$-$CD_n$, and an EDDS (embedded-all in data lines differential signaling) interface 38 comprising a plurality of data differential pairs. The timing controller 34 generates data signals corresponding to images to be displayed by the LCD panel 32, setting signals for setting the pin voltage levels of the source drivers $CD_1$-$CD_n$, together with a clock signal and control signals for driving the LCD panel 32. The EDDS interface 38 operates on a differential and point-to-point basis. In this embodiment, the clock signal, the setting signals, the control signals and the data signals are embedded and transmitted from the timing controller 34 to each source driver via two corresponding data differential pairs DDP+/−1 and DDP+/−2 of the EDDS interface 38. Each of the source drivers $CD_1$-$CD_n$ includes a receiver/decoder 35 coupled to two corresponding differential pairs DDP+/−1 and DDP+/−2 of the EDDS interface 38. Each receiver/decoder 35 can decode the received embeddedly transmitted signals sent from the timing controller 34, thereby generating corresponding clock signal, setting signals, control signals and data signals for the corresponding source driver. In the actual operation, even though each receiver/decoder 35 is coupled to two corresponding differential pairs DDP+/−1 and DDP+/−2, the receiver/decoder 35 can utilize independent or collective hardware to deal with the embedded signals from two differential pairs. In other words, the receiver/decoder 35 can receive and decode the embedded signals from two differential pairs with either two independent circuits or one collective circuit. Each source driver can then output driving signals to the LCD panel 32 based on the decoded signals. Therefore, the present invention does not require extra signal lines for transmitting the clock signal, the setting signals and the control signals.

Figure 4:
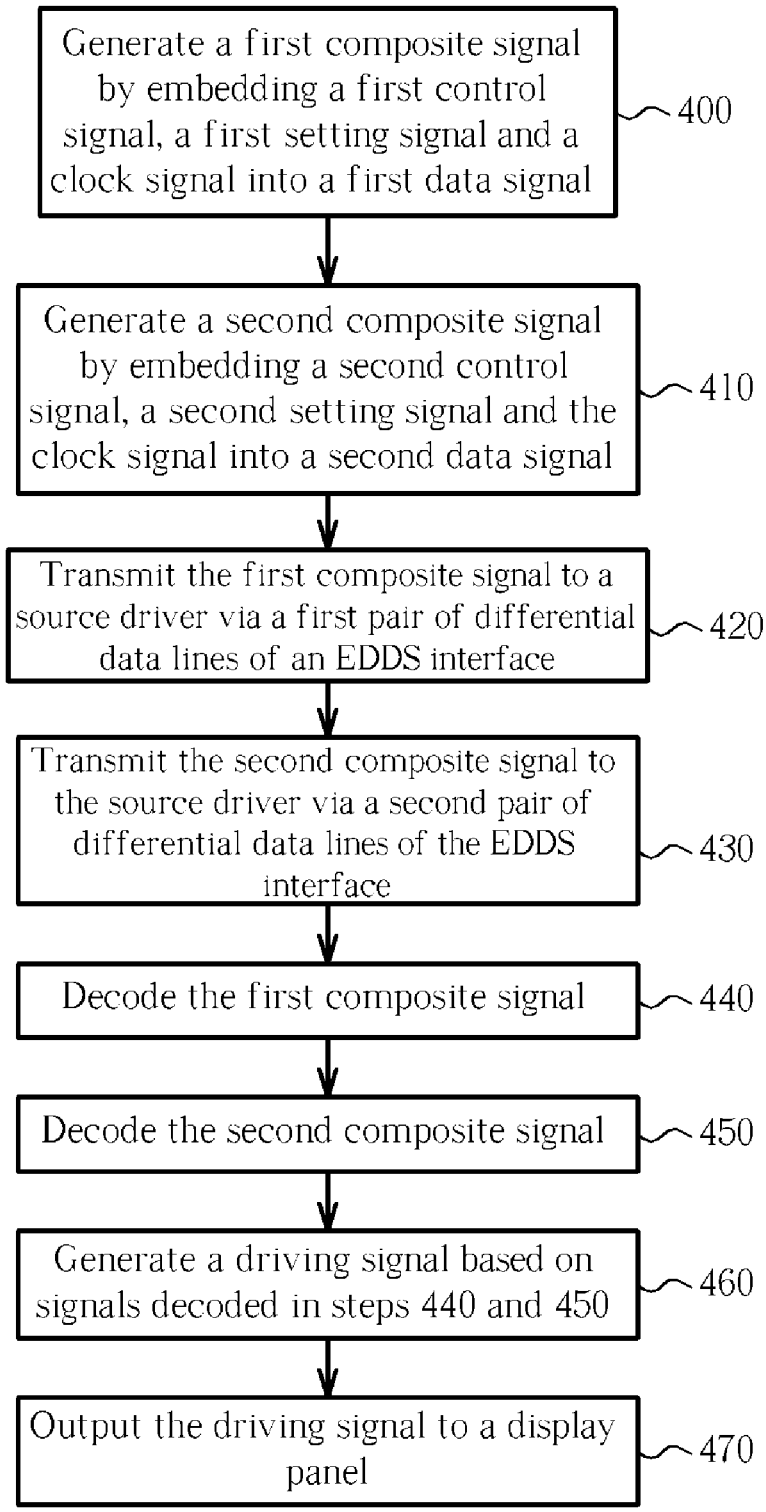
FIG. 4 is a flowchart illustrating a method for data transmission according to the present invention.

Reference is made to FIG. 4 for a flowchart illustrating a method for data transmission between a timing controller and source drivers according to the present invention. The flowchart in FIG. 4 includes the following steps:

Step 400: generate a first composite signal by embedding a first control signal, a first setting signal and a clock signal into a first data signal.

Step 410: generate a second composite signal by embedding a second control signal, a second setting signal and the clock signal into a second data signal.

Step 420: transmit the first composite signal to a source driver via a first pair of differential data lines of an EDDS interface.

Step 430: transmit the second composite signal to the source driver via a second pair of differential data lines of the EDDS interface.

Step 440: decode the first composite signal.

Step 450: decode the second composite signal.

Step 460: generate a driving signal based on signals decoded in steps 440 and 450.

Step 470: output the driving signal to a display panel.

As mentioned above, the receiver/decoder can receive and decode the embedded signals from two differential pairs with either two independent circuits or one collective circuit. In the present invention, the clock signal and the control signals are embedded into the data signals, and the embedded signals are transmitted via two data differential pairs of the EDDS interface on a differential and point-to-point basis. Therefore, the present invention can reduce signal reflection and skew issue in high-speed operations, making it easier to adjust timing parameters, such as the setup time and the hold time. In addition, since the setting signals are also embedded into the data signals, the pin pitch of the source drivers can be increased and the yield of the bonding process will be higher. Therefore, the present invention provides a simpler EDDS interface that can reduce manufacturing costs and improve the efficiency of data transmission in the display devices.

In the present invention, the clock signal, the setting signals and the control signals can be embedded into the data signals in many ways. For example, the clock signal, the setting signals and the control signals can be embedded as protocols into the data signals. Based on the protocols, the decoders of the source drivers can decode the embedded signals and generate corresponding clock signals, setting signals and control signals. The setting signals can include DATAPOL signals, SHL signals and SHR signals for respectively setting the data-inversion pins, the shift-left pins and the shift-right pins of the source drivers, or signals for setting other pins of the source drivers. The control signals can include latch control signals LD, polarity control signals POL, start pulse signals SP, or other signals for driving the source drivers.

In the present invention, skew issue and timing parameters can easily be adjusted. The synchronization between the data and the clock signals, especially in high-speed operations, is made possible by embedding the clock signal into the data signals. The synchronization between the data and the control signals is also made possible by embedding the protocol of control signals into the data signals, such that the PCB can provide more available circuit space and requires fewer layers, which means cost reduction. The synchronization between the data signals and the setting signals is also made possible by embedding the setting signals into the data signals, thereby increasing the pin pitch and yield while reducing the overall manufacturing costs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display system capable of embeddedly transmitting data signals, control signals, clock signals and setting signals via an EDDS (embedded-all in data lines differential signaling) interface comprising:

a source driver having:

an outputting means for outputting embedded signals including data signals, control signals, clock signals and setting signals, the setting signals including DATAPOL signals, SHL signals and SHR signals for respectively setting the data-inversion pins, the shift-left pins and the shift-right pins of the source driver;

a first receiving means operative based on a first embedded signal that includes a first setting signal, the data signals, the control signals, and the clock signals, and comprising a first decoding means for decoding the first embedded signal and thereby generating a corresponding driving signal; and a second receiving means operative based on a second embedded signal that includes a second setting signal, the data signals, the control signals, and the clock signals, and comprising a second decoding means for decoding the second embedded signal and thereby generating the corresponding driving signal; and a controller having an EDDS interface comprising:

a first pair of differential data lines for transmitting the first embedded signal outputted by the outputting means to the first receiving means; and a second pair of differential data lines for transmitting the second embedded signal outputted by the outputting means to the second receiving means.

2. The display system of claim 1 further comprising a timing controller for generating the data signals, the control signals, the clock signals and the setting signals.

3. The display system of claim 1 further comprising a plurality of source drivers each including the first receiving means and the second receiving means.

4. The display system of claim 3 further comprising a display panel coupled to the plurality of source drivers for displaying images based on the driving signal.

5. The display system of claim 1, wherein the first decoding means and the second decoding means are operated with a collective circuit.

6. A display system comprising:

a display panel having a plurality of scan lines and a plurality of data lines formed in a matrix type;

a plurality of gate drivers coupled to the display panel for driving the scan lines;

a plurality of source drivers coupled to the display panel for driving the data lines; and a timing controller for providing at least one data signal, at least one control signal, at least one clock signal and at least one setting signal to the source driver, where the at least one setting signal is selected from a group consisting of DATAPOL signals, SHL signals and SHR signals for respectively setting the data-inversion pins, the shift-left pins and the shift-right pins of the source driver;

wherein the data signal, the control signal, the clock signal and the setting signal are transformed into at least one composite signal and transmitted from the timing controller to the source driver through at least one data differential pair.

7. The display system of claim 6, wherein the control signal, the setting signal and the clock signal are embedded into the data signal to form the composite signal.

8. The display system of claim 6, wherein the source driver comprises:

at least one receiver for receiving the composite signal from two data differential pairs; and at least one decoder for decoding the composite signal.

9. A method for embeddedly transmitting data signals, control signals, clock signals and setting signals comprising the following steps:

(a) generating a first composite signal by embedding a first control signal, a first setting signal and a clock signal into a first data signal;

(b) generating a second composite signal by embedding a second control signal, a second setting signal and the clock signal into a second data signal;

(c) transmitting the first composite signal to a first receiving means;

(d) transmitting the second composite signal to a second receiving means;

(e) decoding the first composite signal; and (f) decoding the second composite signal;

wherein the first and the second setting signals are selected from a group consisting of DATAPOL signals, SHL signals and SHR signals for respectively setting the data-inversion pins, the shift-left pins and the shift-right pins of a source driver.

10. The method of claim 9 wherein step (c) comprises transmitting the first composite signal to the first receiving means via a first pair of differential data lines, and step (d) comprises transmitting the second composite signal to the second receiving means via a second pair of differential data lines.

11. The method of claim 9 wherein step (c) comprises transmitting the first composite signal to a first receiving means of the source driver, and step (d) comprises transmitting the second composite signal to a second receiving means of the source driver.

12. The method of claim 9 further comprising generating the first and second control signals, the first and second setting signals and the clock signal.

13. The method of claim 9 wherein step (e) comprises decoding the first composite signal and thereby generating a corresponding driving signal, and step (f) comprises decoding the second composite signal and thereby generating the corresponding driving signal.

14. The method of claim 13 further comprising outputting the corresponding driving signal to a display panel.

15. The method of claim 9 wherein step (a) comprises generating the first composite signal by embedding the first control signal, the first setting signal and the clock signal as protocols into the first data signal, and step (b) comprises generating the second composite signal by embedding the second control signal, the second setting signal and the clock signal as protocols into the second data signal.

16. A method for transmitting driving signals in a display system comprising the following steps:

(a) transforming at least one data signal, at least one control signal, at least one clock signal and at least one setting signal into at least one composite signal, the at least one setting signal selected from a group consisting of DATAPOL signals, SHL signals and SHR signals for respectively setting the data-inversion pins, the shift-left pins and the shift-right pins of a source driver;

(b) transmitting the composite signal from a timing controller to the source driver through at least one data differential pair; and (c) receiving and decoding the composite signal.

17. The method of claim 16, wherein step (a) comprises embedding the control signal, the setting signal and the clock signal into the data signal to form the composite signal.

18. The method of claim 16, wherein the source driver comprises:

at least one receiver for receiving the composite signal from two data differential pairs; and at least one decoder for decoding the composite signal.

19. The method of claim 16, wherein the at least one control signal is selected from a group consisting of latch control signals, polarity control signals, and start pulse signals for driving the source driver.

* * * * *